US008960457B2

(12) United States Patent
Brisendine

(10) Patent No.: US 8,960,457 B2
(45) Date of Patent: Feb. 24, 2015

(54) METHOD AND APPARATUS FOR A FLOATING SHELF ASSEMBLY

(76) Inventor: Shawn Brisendine, Apex, NC (US)

( * ) Notice: Subject to any disclaimer, the term of this patent is extended or adjusted under 35 U.S.C. 154(b) by 178 days.

(21) Appl. No.: 13/278,233

(22) Filed: Oct. 21, 2011

(65) Prior Publication Data

US 2012/0097629 A1 Apr. 26, 2012

Related U.S. Application Data

(60) Provisional application No. 61/406,848, filed on Oct. 26, 2010.

(51) Int. Cl.

| | |
|---|---|
| ***A47F 5/08*** | (2006.01) |
| ***A47B 43/00*** | (2006.01) |
| *B66B 9/00* | (2006.01) |
| *E04B 7/16* | (2006.01) |
| *A47B 67/02* | (2006.01) |

(52) U.S. Cl.

CPC ..... *A47B 43/006* (2013.01)
USPC ..... 211/113; 211/86.01; 211/150; 52/29; 52/73; 312/248

(58) Field of Classification Search

USPC ..... 211/90.01, 96, 87.01, 86.01, 149, 150, 211/134, 113, 117, 118, 115, 116; 108/42, 108/33, 35, 38, 149, 164, 134, 135; 312/245, 248, 242; 52/29, 36.4, 73; 248/235, 240–240.4; 297/14; 40/601, 40/606.14, 606.15

See application file for complete search history.

(56) References Cited

U.S. PATENT DOCUMENTS

| | | | | |
|---|---|---|---|---|
| 676,619 | A | | 6/1901 | Faethe |
| 778,719 | A | | 12/1904 | Stephenson |
| 2,662,645 | A | | 12/1953 | Piton |
| 3,025,970 | A | | 3/1962 | Ostrom |
| 3,041,033 | A | | 6/1962 | Schwartz |
| 3,158,348 | A | | 11/1964 | Rutter |
| 3,588,959 | A | * | 6/1971 | Russo ..... 425/589 |
| 3,901,165 | A | | 8/1975 | Schlesinger |
| 3,994,462 | A | | 11/1976 | Shine |
| 4,015,809 | A | | 4/1977 | Buril |
| 4,061,092 | A | | 12/1977 | Jacobsen et al. |
| 4,129,080 | A | | 12/1978 | Vall |

(Continued)

FOREIGN PATENT DOCUMENTS

WO 03/065851 A1 8/2003

*Primary Examiner* — Joshua J Michener
*Assistant Examiner* — Devin Barnett
(74) *Attorney, Agent, or Firm* — Murphy, Bilak & Homiller, PLLC

(57) ABSTRACT

In one aspect, the present invention provides a "floating" shelf assembly that is configured for mounting on attic rafters or exposed wall studs. In at least one embodiment, the shelf assembly comprises a shelf that includes rotatable mounts at a first edge, which are configured to mount to adjacent rafters at a desired height above the attic floor or insulation. The shelf further includes flexible members which are configured to hang the opposing, second edge of the shelf from an overhead mounting point. The ability to rotate the shelf relative to its mounted first edge allows easy leveling of the shelf by adjusting the hanging length of the flexible members suspending the second edge of the shelf. The shelf assembly also permits direct use with wall studs, where the rotatable mounts are attached to the wall studs and the flexible members are pulled taught, diagonally back and above the shelf.

5 Claims, 8 Drawing Sheets

(56) References Cited

U.S. PATENT DOCUMENTS

| | | | | |
|---|---|---|---|---|
| 4,244,301 | A | 1/1981 | Nakatsu | |
| 4,974,523 | A | 12/1990 | Giarratana | |
| 5,239,790 | A | 8/1993 | Fetzer | |
| 5,427,344 | A | 6/1995 | Beauchemin | |
| 5,472,103 | A | 12/1995 | Merl | |
| 5,556,179 | A | 9/1996 | Weidner | |
| 5,560,501 | A | 10/1996 | Rupert | |
| 5,601,016 | A | 2/1997 | Witte | |
| 5,758,782 | A | 6/1998 | Rupert | |
| 5,794,385 | A * | 8/1998 | Donovan | 52/36.4 |
| 5,967,478 | A | 10/1999 | Tynes | |
| 5,988,578 | A | 11/1999 | Davies | |
| 6,224,029 | B1 | 5/2001 | Marble et al. | |
| 6,354,548 | B1 | 3/2002 | Stephen et al. | |
| 7,243,887 | B2 | 7/2007 | Magnusson | |
| 7,246,865 | B1 | 7/2007 | Merrell, II | |
| 7,249,685 | B2 | 7/2007 | Newman | |
| 7,389,614 | B2 | 6/2008 | Sullivan | |
| 7,497,343 | B2 | 3/2009 | Newman | |
| 2003/0164347 | A1 | 9/2003 | Bouvier, Jr. | |
| 2003/0226944 | A1 | 12/2003 | Sode | |
| 2006/0096821 | A1 | 5/2006 | McKaba | |
| 2006/0277894 | A1 * | 12/2006 | Lin | 59/80 |
| 2008/0224002 | A1 | 9/2008 | Butow | |
| 2008/0245755 | A1 | 10/2008 | Carter | |
| 2010/0282698 | A1 | 11/2010 | Scheid | |

* cited by examiner

METHOD AND APPARATUS FOR A FLOATING SHELF ASSEMBLY

RELATED APPLICATIONS

This application claims priority under 35 U.S.C. §119(e) from the U.S. provisional patent application filed on 26 Oct. 2010 and identified by Application No. 61/406,848, which is expressly incorporated in its entirety herein by reference.

BACKGROUND

Efforts to more efficiently use the limited storage space found in most homes drives a large industry focused on providing homeowners with various storage systems, including boxes, bins, shelves, stacking systems, etc. Perhaps in recognition that attics present unused or underutilized storage opportunities, U.S. Pat. No. 5,239,790 discloses an attic shelving system. The system uses pairs of rigid shelving supports that nail to trusses and provide for sliding engagement of shelves—also, see U.S. Pat. No. 7,389,614 for another example attic storage system.

Further attempts to make use of exposed framing members can be found in the following patents or patent publications: U.S. Pat. No. 3,041,033 discloses a (rigid) bracket for mounting on exposed building frame members, to create a type of suspended shelving; U.S. Pub. 2003/0226944 discloses a shelving support bracket for attachment to an exposed stud; and U.S. Pub. 2008/0224002 discloses a "dual use" bracket designed for mounting on a truss and including "flaps" for supporting shelving or flooring.

While the above examples and other known storage solutions demonstrate various approaches to exploiting building framing members for shelving support and/or to exploit attic storage space, there remain opportunities for developing improved storage solutions that are more easily installed, more easily leveled, etc.

SUMMARY

In one aspect, the present invention provides a "floating" shelf assembly that is configured for mounting on attic rafters or exposed wall studs. In at least one embodiment, the shelf assembly comprises a shelf that includes rotatable mounts at a first edge, which are configured to mount to adjacent rafters at a desired height above the attic floor or insulation. The shelf further includes flexible members which are configured to hang the opposing, second edge of the shelf from an available overhead mounting point. The ability to rotate the shelf relative to its mounted first edge allows easy leveling of the shelf simply by adjusting the hanging length of the flexible members used to suspend the second edge of the shelf. The flexible members are, for example, plastic or fabric straps (webs) and they may include integral length adjustments, or may simply provide for attachment at various points along their lengths.

Note that in the above example, the first edge of the shelf generally will be the front edge and the second edge the back edge, according to the expected nature of attic space and direction in which attic framing normally slopes. Of course, it will be understood that the above use of "front" and "back" is non-limiting and the shelf assembly of the present invention may be mounted such that its back edge is the fixed-height, rotably mounted edge, with its front edge being suspended from the flexible members. This orientation is advantageous, for example, when the shelf assembly is used with an unfinished wall. In such applications, the rotatable mounts on the first edge of the shelf are attached to exposed wall studs so that the shelf projects outward perpendicularly from the wall, and the flexible members are then used to suspend the front-edge of the shelf—e.g., the flexible members are pulled taught diagonally back and up for attachment to the wall.

With the above in mind, one or more embodiments of the present invention comprise a shelf assembly that includes a shelf having rotatable mounts on opposing sides of a first edge and flexible members on opposing sides of a second edge, where the first and second edges are front and back edges or back and front edges, depending upon the selected mounting orientation of the shelf. With this configuration, one edge of the shelf is rotably fixed at a desired height to available surrounding supports (e.g., exposed attic rafters or wall studs), and the other end of the shelf is suspended by attaching the flexible members to an available overhead support, where the hanging length of the flexible members is selected or otherwise adjusted by the person installing the shelf assembly, to obtain a level orientation of the shelf.

In a particular embodiment, the shelf assembly includes a shelf having opposing first and second sides or ends and a load surface extending therebetween, and a flexible member extending from opposing edges of the first side or end of the shelf, each such flexible member having a free length for suspending the first side or end of the shelf. Here, the height at which the first side or end of the shelf is suspended is determined by selecting a point along the free lengths of said flexible members from which to hang the shelf and attaching the flexible members to an available overhead supporting structure at the selected point. Alternatively, the flexible members are straps or belts, or the like, and incorporate a length adjustment feature that provides for easy adjustment of suspension height.

In any case, the shelf assembly further includes, as the aforementioned rotatable mounts, a rigid member that extends from opposing edges of the second side or edge of the shelf and includes mounting points at each of its ends, for fixedly mounting the rigid member to an available structural support. In at least one such embodiment, the end-to-end length of the rigid member is set to a nominal on-center spacing for attic rafters, such as 24" on-center. In such embodiments, the width of the shelf (where "width" references the span between adjacent rafters or wall studs) is slightly less than the rafter/stud spacing, so that the shelf can be positioned and hung between the adjacent rafters/studs.

In at least one embodiment, the rigid member is rotatably attached to or integrated within the shelf, such that said shelf rotates relative to said rigid member and is thereby leveled by adjusting the suspension height of the first side or end of the shelf, to rotate the shelf into a level position. As noted, in one or more embodiments, the flexible members used to suspend the shelf comprise one or more straps, ropes, or chains. In at least one embodiment, the flexible members each include a like positioned and like spaced series of mounting holes, to facilitate attachment of said free lengths of said flexible members to an available support structure. Also, as noted, in one or more embodiments, each flexible member comprises a strap or belt having a length-adjusting mechanism, to facilitate adjusting a suspension height of the shelf when suspended from said flexible members.

Of course, the present invention is not limited to the above brief summary of features and advantages. Those of ordinary skill in the art will recognize additional features and advantages from the following detailed description of example embodiments, and from the accompanying example illustrations.

DETAILED DESCRIPTION

One or more embodiments of the shelf assembly disclosed herein is designed to be used in attics with a truss roofing system and the assembly offers significant advantages for attics that have blown insulation because the shelf assembly "floats" above the insulation. In attics having at least some flooring for storage, the floating shelf assemblies disclosed herein allow floating shelves to be installed around or adjacent to that floored area, to greatly extend the amount of usable attic storage without requiring additional flooring and without interfering with existing insulation.

In particular, the shelves can be hung between the trusses adjacent to the existing platform. Such an arrangement puts one or more floating shelves (as taught herein) within easy reach of a person standing on the preexisting platform. For additional convenience, the floating shelves can be arranged at various levels to accommodate different size storage totes or boxes, allowing each tote or box to be removed without moving the ones above. Such arrangements allow for better organization without the need to stack and un-stack totes or boxes.

Figure 1:
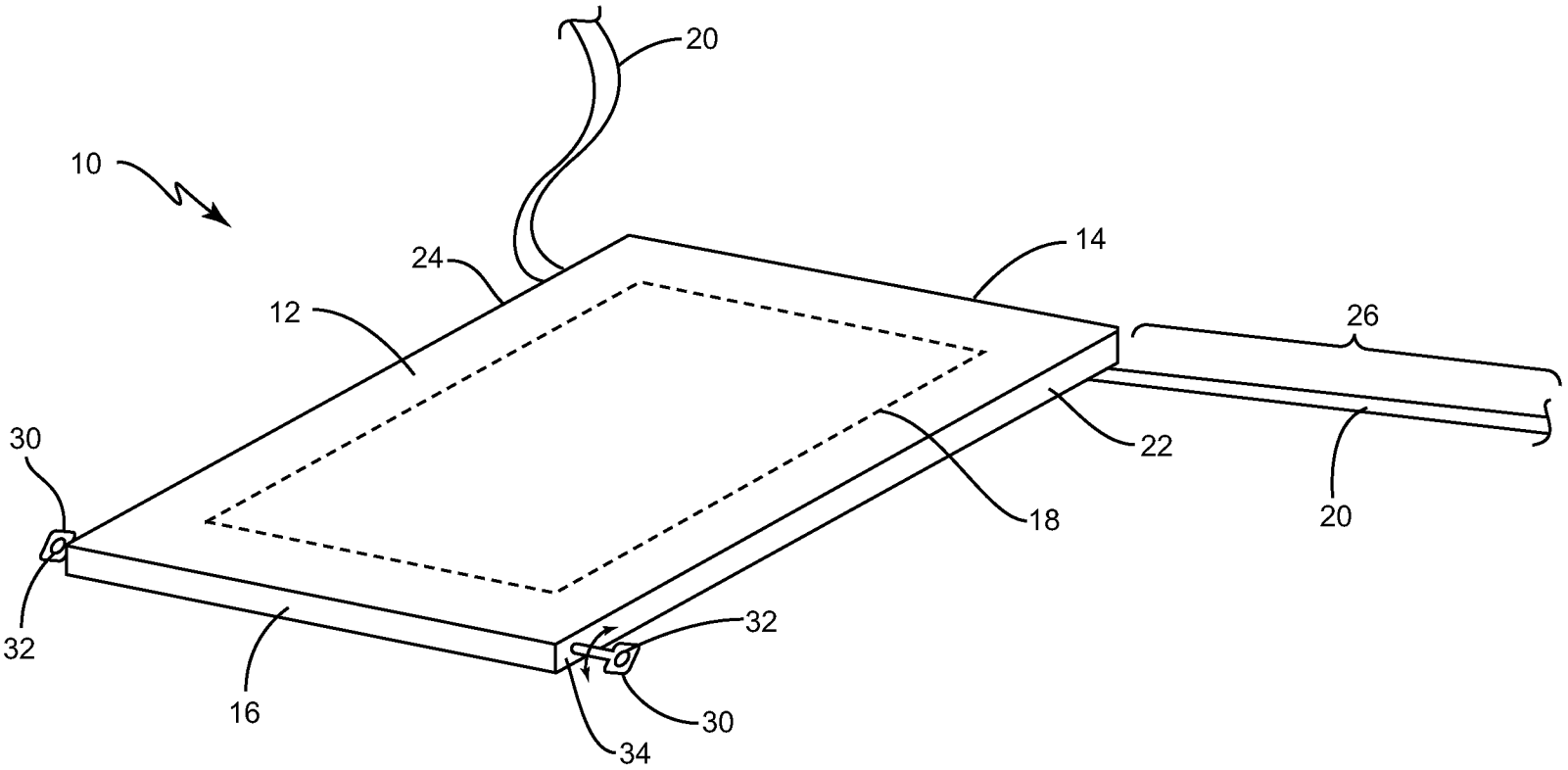
FIG. 1 is a perspective view of a shelf assembly according to one embodiment of the present invention.

To better understand the above shelf configurations and attendant advantages, FIG. 1 illustrates an example shelf assembly 10. In a particular embodiment, the shelf assembly 10 includes a shelf 12 having a first side (or end, depending upon the frame of reference) 14 and a second side (or end) 16, and a load surface 18 extending therebetween. One also sees a flexible member 20 extending from opposing edges 22 and 24 of the first side 14 of the shelf 12. Each flexible member 20 has a free length 26 for suspending the first side 14 of the shelf 12. Here, the height at which the first side 14 of the shelf 12 is suspended is determined by selecting a point along the free lengths 26 of the flexible members 20 from which to hang the shelf 12 and attaching the flexible members 20 to an available overhead supporting structure at the selected point.

The shelf assembly 10 further includes rotatable mounts 30 projecting outward from the opposing edges 22 and 24 of the shelf 12. More particularly, the rotatable mounts 30 are positioned at or toward the second side or end 16 of the shelf 12—i.e., at the side or end opposite from the side or end having the flexible members 20, so that one side or end of the shelf 12 is supported by the flexible members 20 while the other side or end of the shelf 12 is supported by the rotatable mounts 30. Each rotatable mount 30 incorporates or otherwise provides a mounting hole or other feature 32 that provides for attachment of the rotatable mount 30 to an available mounting surface (such as the leading edge of a attic truss or an exposed wall stud).

The above arrangement provides for fixing the mounted height of the shelf 12 by virtue of attaching the rotatable mounts 30 to an available supporting structure at the desired vertical height, and then rotating the shelf 12 into a level position by adjusting the hanging length of the flexible members 20. Once the appropriate hanging length is determined, the shelf installer simply fastens the flexible members to the available overhead support at the appropriate point along their free lengths 26 to obtain the desired hanging height.

Figure 2:
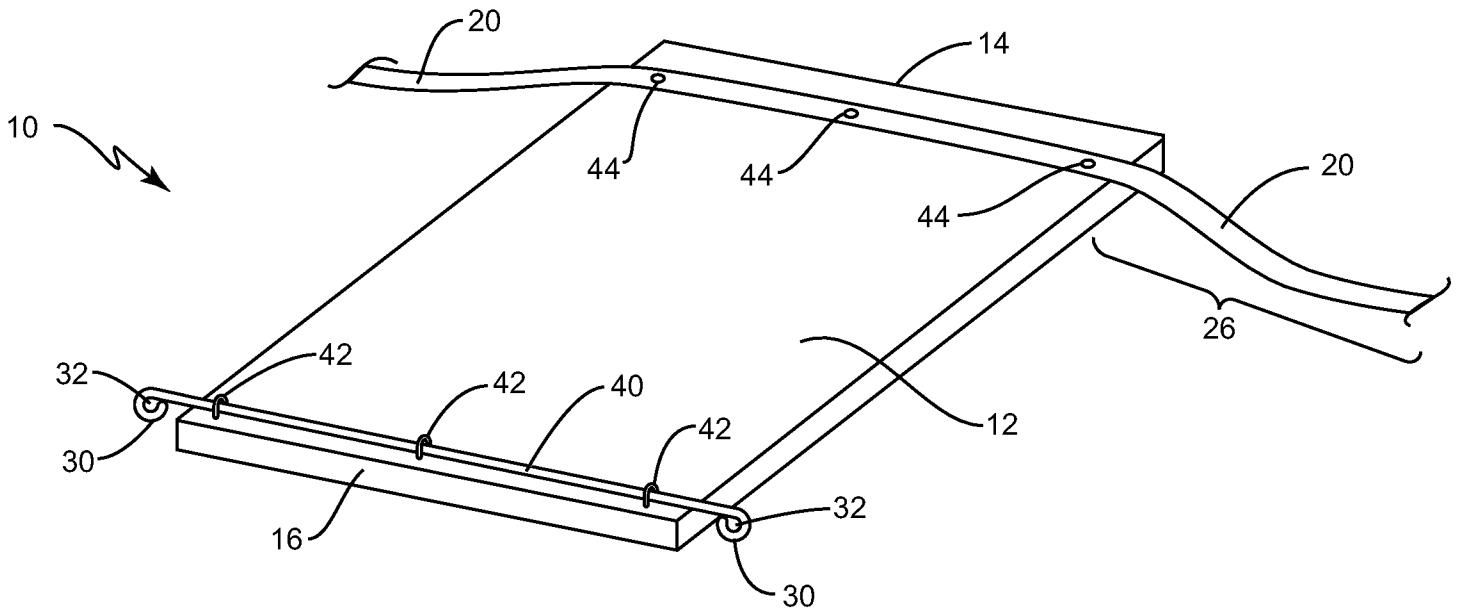
FIG. 2 provides a bottom view of the shelf assembly of FIG. 1.

Also note from FIG. 1 that the shelf 12 may be thicker at its rotatable-support end, to provide extra support for, or incorporation of, the rotatable mounts 30. In FIG. 1, one sees an additional member 34 running along the underside of the shelf 12 at the second side or end 16. In the diagram, the rotatable mounts 30 are affixed to or otherwise carried by the additional member 34. Other variations are contemplated, such as where the additional member 34 does not run the full length of the shelf's underside but instead is implemented as built-up areas at each corner of the shelf 12 where the rotatable mounts 30 are carried. FIG. 2 illustrates yet another variation.

Whereas FIG. 1 illustrated the shelf 12 from a top-side perspective, FIG. 2 illustrates a bottom-side perspective view of the shelf 12 and, in particular, illustrates an advantageous and economical implementation of the rotatable mounts 30. Here, the rotatable mounts 30 are integrally formed as opposing ends of a rigid member 40 (e.g., a steel rod) running underneath the shelf 12 at the second side or end 16. The rigid member 40 is rotatably fixed to the underside of the shelf 12 using a series of spaced apart heavy grade staples or other "loop" fasteners 42, such that its ends are rotatable with respect to the shelf 12. These ends may be curled or otherwise formed to provide the rotatable mounts 30, including the mounting holes 32.

Figure 3:
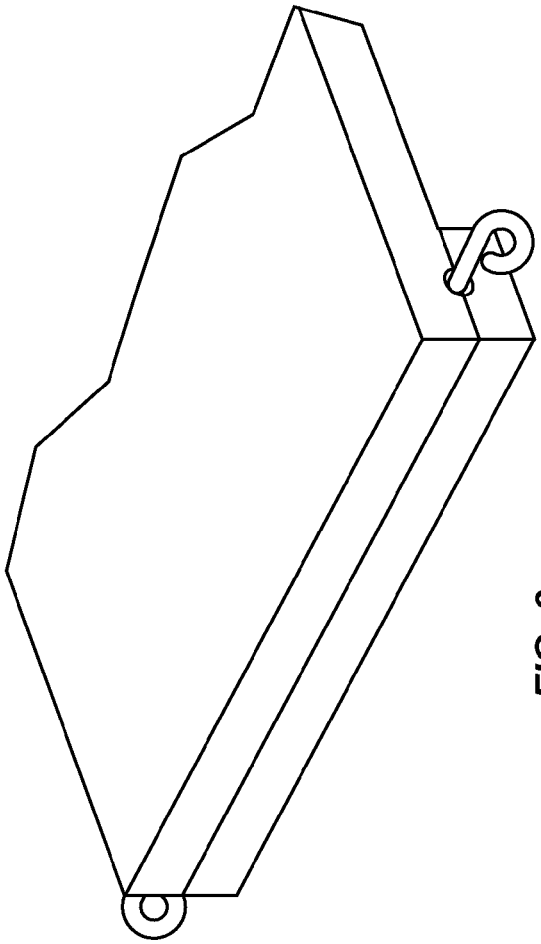
FIG. 3 is a partial illustration of a shelf assembly, showing one embodiment of the rotatable (shelf) mounts used in one or more embodiments herein.

It will also be appreciated that the underside of the shelf 12 may include a channel for carrying the rigid member 40 and that a board or plate can be fixed over all or a portion of that channel, to trap and retain the rigid member 40. Such an arrangement is shown in FIG. 3.

Finally, with respect to FIG. 2, one sees that the flexible members 20 may be formed as one continuous member that is riveted, stapled, or otherwise fastened to the underside of the shelf 12 by way of fasters 44. One variation is to implement the flexible members 20 as separate straps or other flexible webs, etc., which are each attached at one end to an underside corner of the shelf 12. Other convenience and usability aspects of the flexible members 20 are considered herein.

Figure 4:
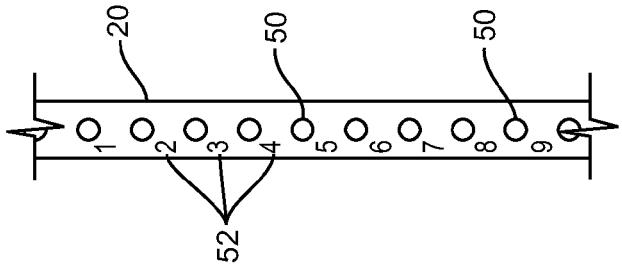

For example, FIG. 4 depicts a portion of a flexible member 20 having pre-fabricated mounting holes 50 positioned at uniformly spaced intervals. The flexible member 20 may carry indicia 52 in correspondence with the holes 50 so that the shelf installer can easily locate the corresponding hole 50 on each flexible member 20, to insure level hanging of the shelf 12. For example, the holes 50 can be numbered, e.g., "1," "2," "3," and so on from the same starting point on each flexible member 20.

Figure 6:
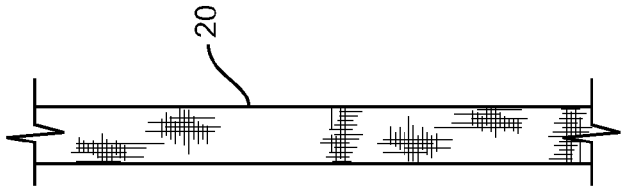
FIGS. 4-6 illustrate example embodiments of the flexible members advantageously used for suspending a shelf assembly as taught herein.
Figure 5:
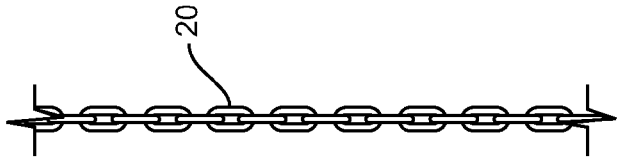

FIGS. 5 and 6 show other variations. In particular, FIG. 5 illustrates the use of a linked chain as a flexible member 20, which has decided advantages in terms of fastening to overhead support structures. FIG. 6 depicts the use of a web as a flexible member, such as a nylon web material, which offers good strength and suppleness and allows for attachment at any point along its free length. Other items contemplated for use in forming the flexible members 20 include polyester or polypropylene straps.

Figure 7:
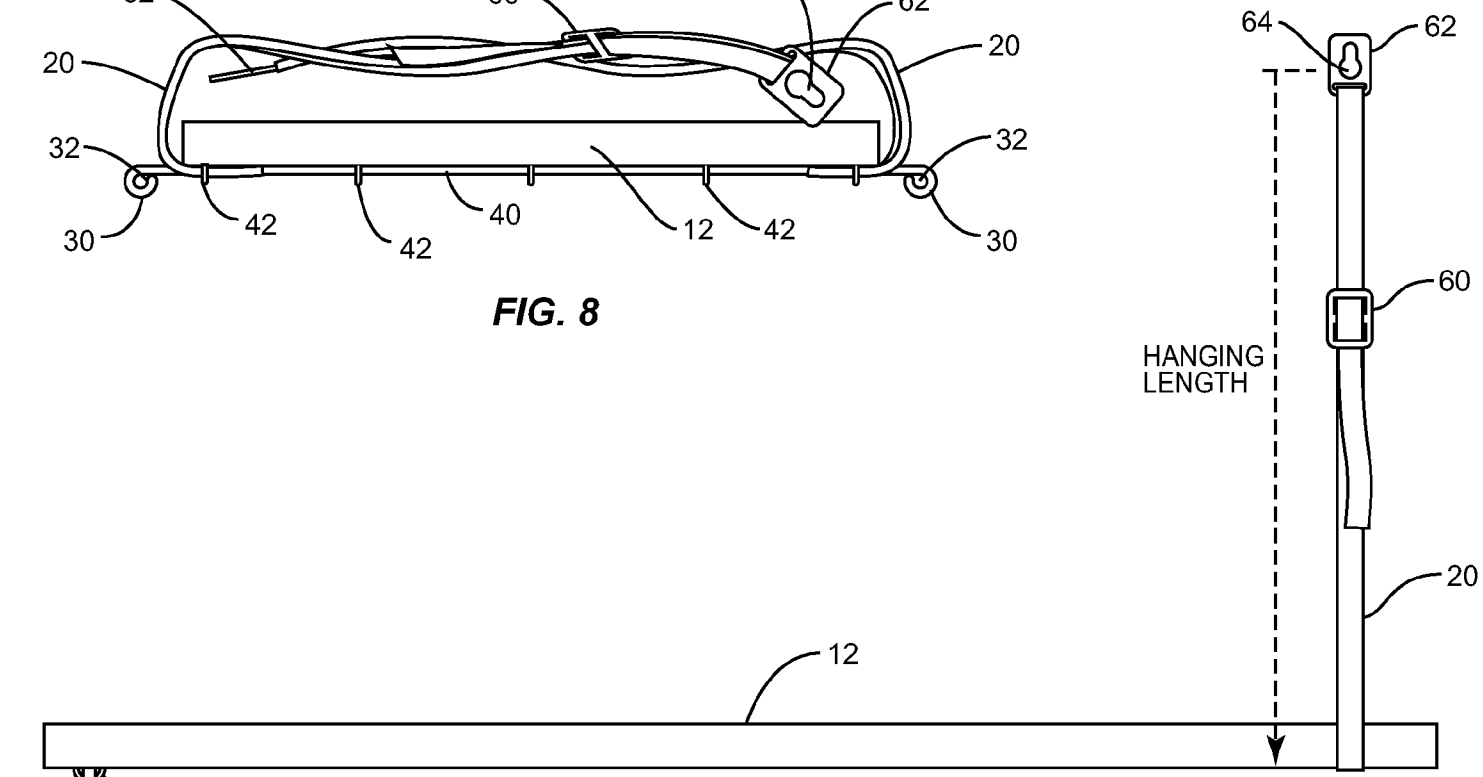
FIG. 7 is a side view of a shelf assembly, showing further example details for an embodiment of the rotatable shelf mounts and flexible suspension members contemplated in one or more embodiments herein, including length adjusting and terminating tab features for the suspension member(s).
Figure 8:
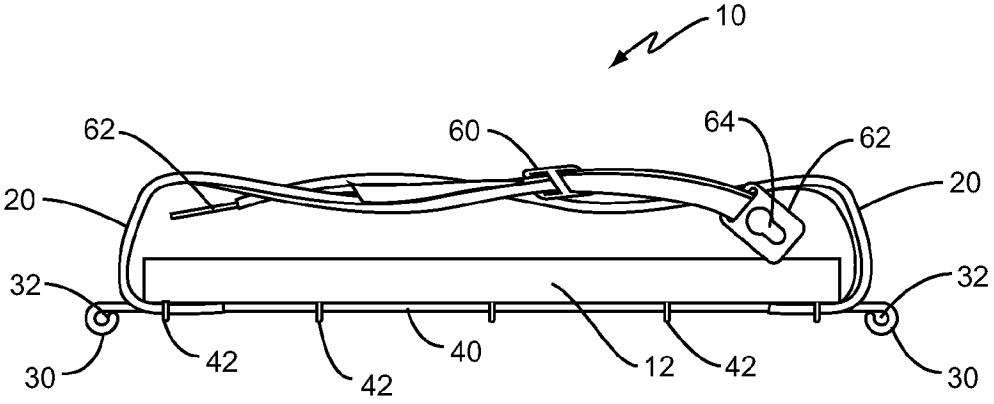
FIG. 8 is a back view of shelf assembly of FIG. 7.

As a further variation, FIGS. 7 and 8 depict side and back views of the shelf assembly 10, respectively, wherein the flexible members 20 are implemented with built-in length adjustability. In particular, in FIG. 7 one sees that the flexible members 20 are implemented as straps that include a built-in buckle or other length adjustment mechanism 60, which allows the hanging length of the flexible member 20 to be adjusted while the shelf assembly is installed in its hanging position. Note that FIGS. 7 and 8 illustrate further optional features, including a terminating tab 62 including a pre-formed hanging aperture 64 at the attachment ends of the flexible members 20. The tab 62, which may be steel or another sufficiently rigid and strong material, allows for easy hanging from a nail, carriage bolt, etc., while providing for quick and easy detachment.

Figure 9:
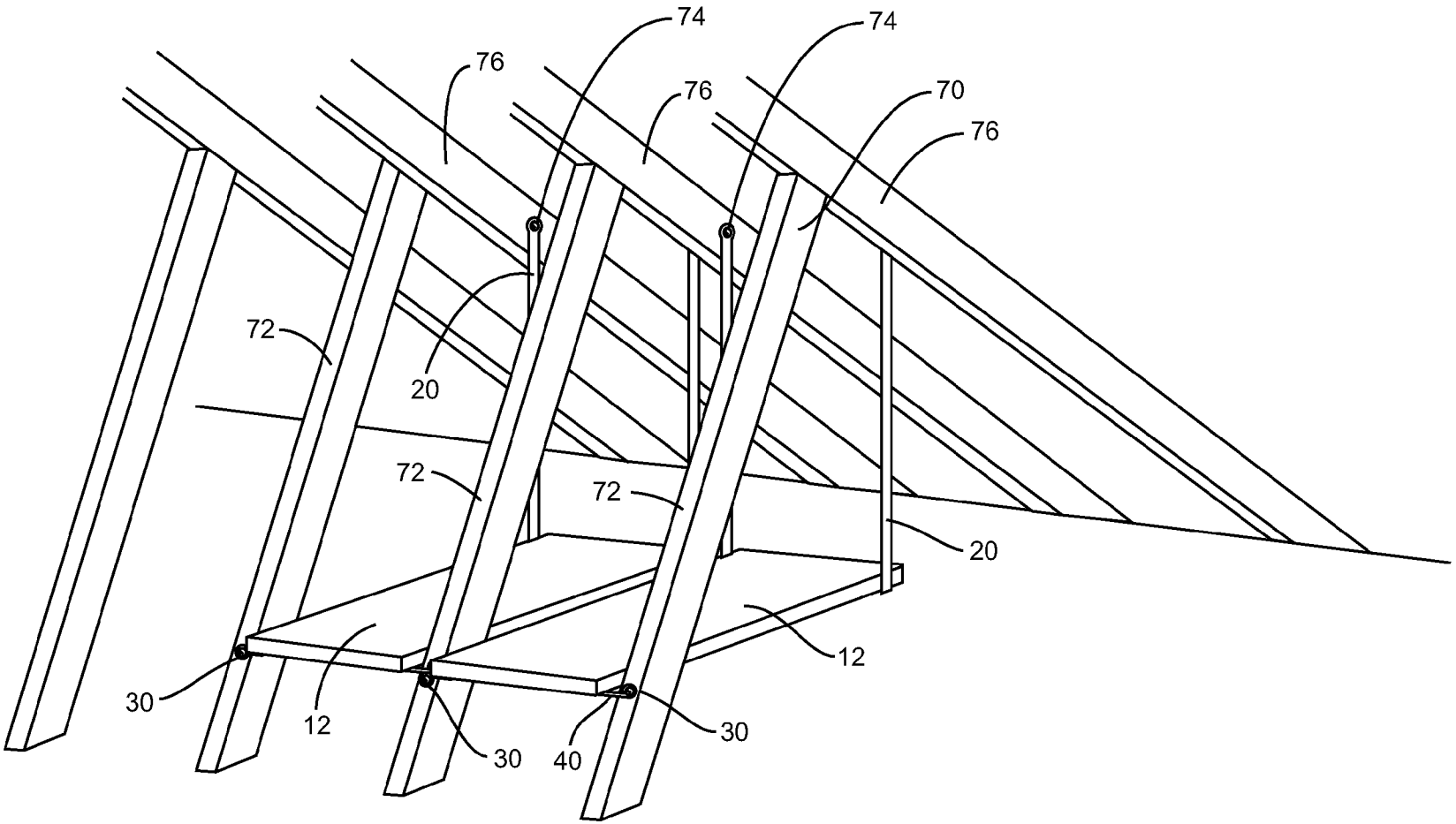
FIG. 9 is a perspective view illustrating adjacent shelf assemblies in an example attic installation.

With the above range of features and advantages in mind, FIG. 9 depicts one embodiment of the shelf assembly 10 in situ within an attic space. One sees two shelf assemblies 10 mounted in a side-by-side arrangement, with each shelf assembly 10 suspended between adjacent trusses 70. One side or end of each shelf 12 is supported by rotatable mounts 30 which are attached to leading edges 72 of the involved trusses 70 at a desired shelf mounting height. The opposite side or end of each shelf 12 is correspondingly supported by the flexible members 20, where the hanging length of each flexible member 20 is set or adjusted to obtain a level orientation of the shelf 12. In particular, one sees that the flexible members 20 may be trimmed or otherwise cut just slightly above the fasteners 74 used to attach them to the overhead rafters 76 of the adjacent trusses 70.

Figure 10:
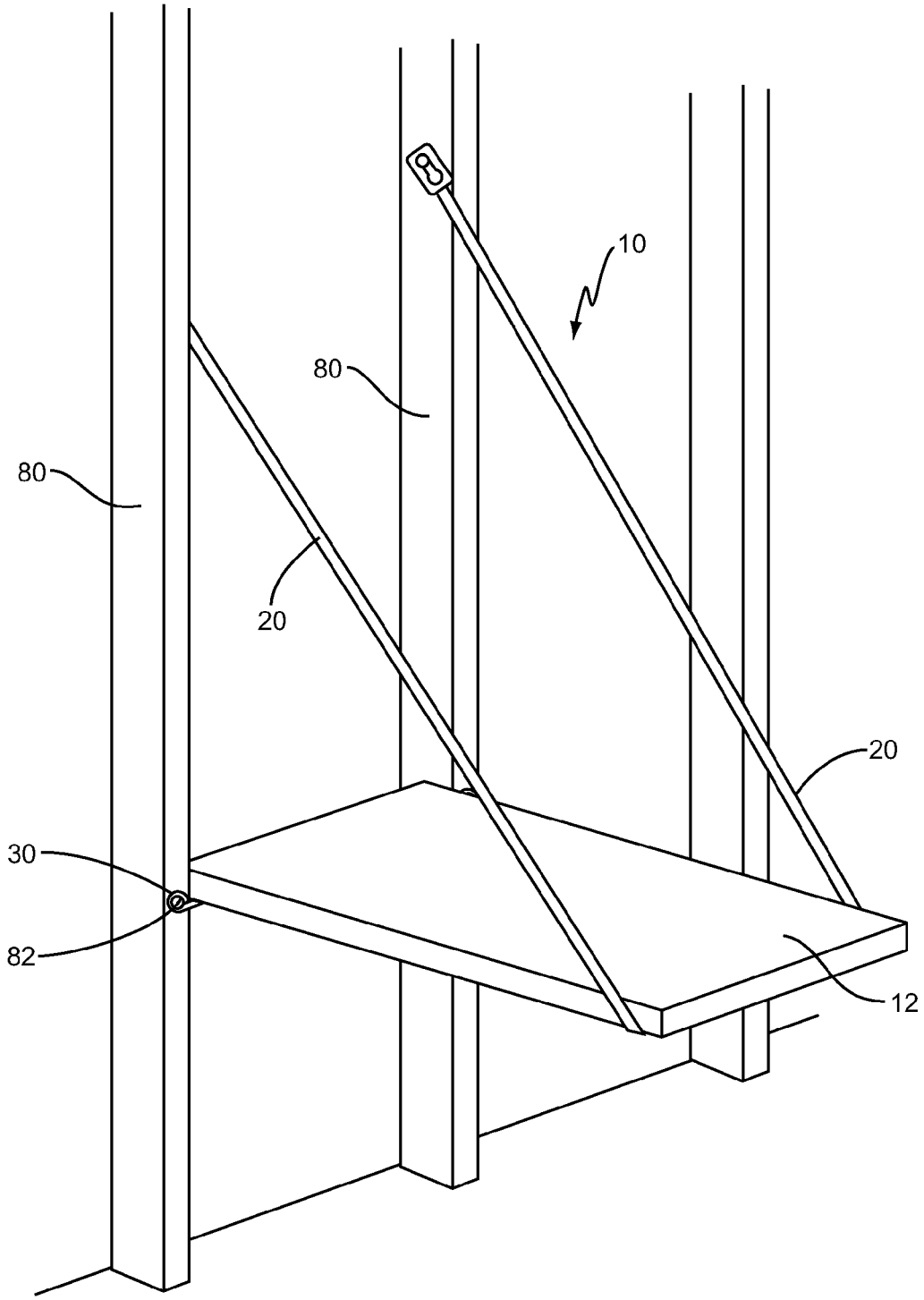
FIG. 10 is a perspective illustrating a shelf assembly in an example wall framing installation.

In this regard, the shelf assembly 10 may be advantageously dimensioned for nominal on-center spacings of roofing trusses, such as 24" on-center, or for nominal on-center stud spacings for use with unfinished walls. One sees such an arrangement in FIG. 10, where the shelf assembly 10 mounts in an orientation that is reversed in some sense from the attic-mounting orientation. That is, the side of the shelf 12 with the rotabable mounts 30 may be understood as the back side or edge of the shelf 12 and is attached to adjacent wall studs 80 by mounting a fastener 82 through the apertures 32 of the rotatable mounts 30. Doing so fixes the back end of the shelf 12 at the desired mounting height and the user then levels the shelf and completes the installation by fastening the flexible members 20 to the wall studs 80 at the appropriate point above the attachment point of the rotatable mounts 30. The "appropriate point" fixes the shelf 12 in a level position.

Thus, in one or more embodiments, the end-to-end spacing of the rotatable mounts 30 is configured such that the mounting points provided by them fall on the nominal on-center spacing of attic rafters and/or wall studs. Note that a common rigid member 40 may run through multiple shelves 12 (e.g., two or more shelves share the same rigid member 40). In such embodiments, the shelves 12 are dimensioned to each fit between adjacent rafters but the rigid member 40 may span multiple rafters, but is dimensioned as a multiple of the on-center spacing so that it terminates in a rotatable mount 30 at each end in alignment with a corresponding rafter. Also, note that wall mounting does not require the shelf 12 to nestle between wall studs, and the shelf 12 may be provided in lengths that are multiples of sixteen inches or other desired on-center spacings.

Figure 11:
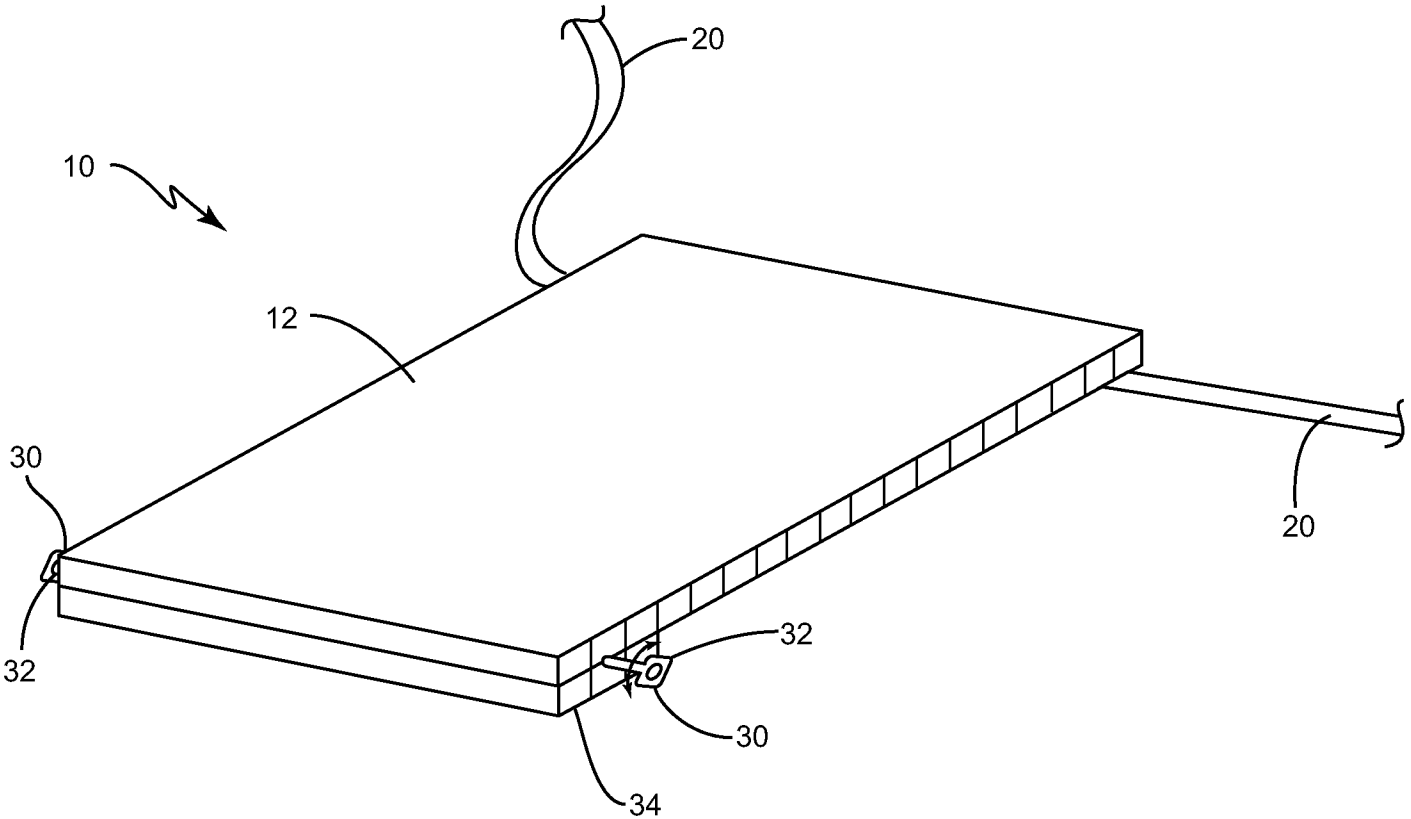
FIG. 11 is a perspective view of another embodiment of a shelf assembly, where the shelf is fabricated from a corrugated material, such as corrugated plastic.

FIG. 11 illustrates yet another embodiment of the shelf assembly 10, wherein at least the shelf 12 and, optionally, the cross-member 34, are fabricated from corrugated material, such as corrugated plastic sheets, such as those manufactured by CORRUGATED PLASTICS, having a business address of CorrugatedPlastics.Net, 649 RT. 206, Suite# 9-160, Hillsborough, N.J., 08844.

Figure 12:
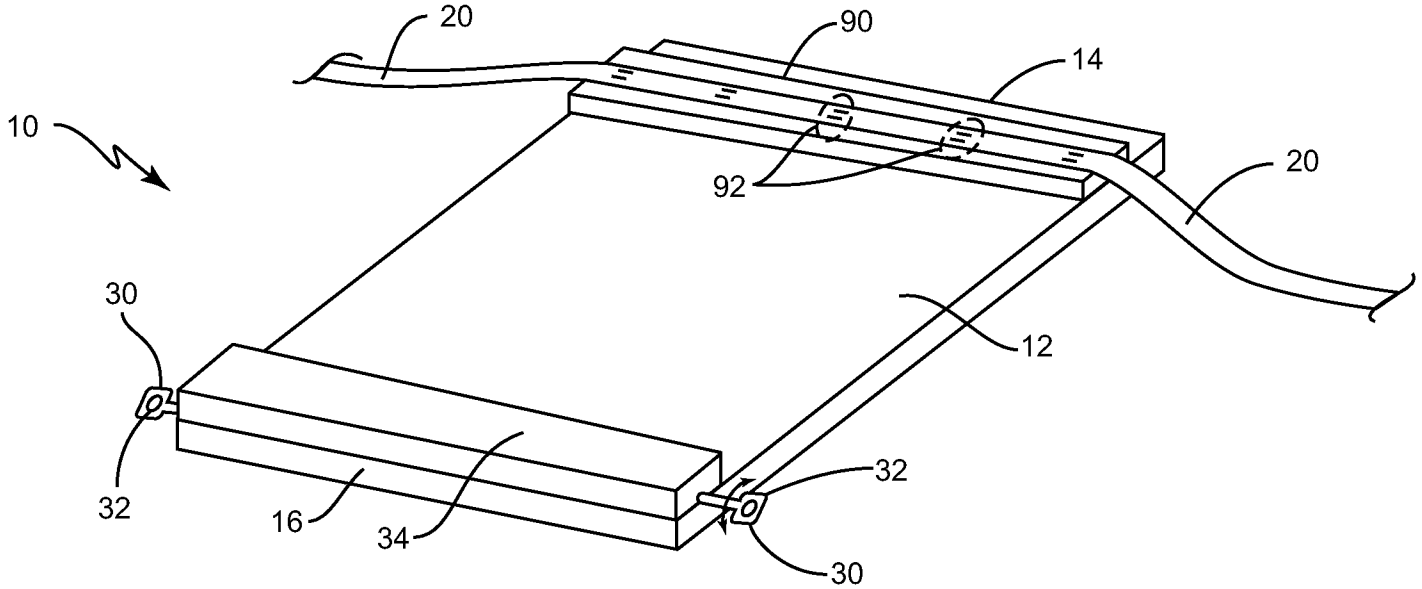
FIG. 12 is a bottom view of yet another shelf embodiment, illustrating example construction and attachment details for the rotatable shelf mounts and suspension members.

FIG. 12 illustrates a further embodiment of the shelf assembly 10, wherein one sees the use of a cross-member 90, in addition to the cross-member 34 introduced in FIG. 1. That is, in one or more embodiments, a cross-member 34 is used on the underside of the shelf 12 on the side or end 16 having the rotatable mounts 30. In this regard, the cross-member 34 advantageously provides additional bracing for the shelf 12 and/or facilitates attachment/retention of the rotatable mounts 30.

Likewise, the cross-member 90, if used, advantageously provides additional bracing for the shelf 12 at the side or end 14 having the flexible members 20 and/or facilitates attachment/retention of the flexible members 20. For example, in the illustrated embodiment, one sees a series of staples 92 used to attach a strap or belt comprising the flexible members 20 to the cross-member 90. Also, note that the cross-member 90 may be inset from the side or end 14, e.g., inset at or about 4" for a 22" or 24" shelf depth, as measured from the side or end 14 to the opposing side or end 16.

In general, the use or omission of cross-members for shelf bracing will depend upon, for example, the implementation of the rotatable mounts 30 and/or flexible members 20, meaning that some configurations of these items are better suited for mounting or retention via the addition of cross-members. Additionally or alternatively, the use or omission of cross-members depends on the stiffness/strength of the shelf 12. For example, cross-members 34 and/or 94 may be preferred with use of a ¼" plywood material for the shelf 12, which offers the advantage of being relatively lightweight as compared to ½" or ¾" materials. Of course, a range of materials are contemplated herein, with some offering the advantage of lighter weight and/or greater stiffness, possibly at the expense of higher cost or greater manufacturing complexity.

In at least one embodiment, the shelf assembly 10 includes a shelf 12 that has dimensions of about ¼"×22"×24". Note that the 22" dimension relates to width of the shelf 12 between sides or edges 22 and 24 shown in FIG. 1, while the 24" dimension relates to the depth of the shelf 12 between sides or ends 14 and 16, also as shown in FIG. 1. Of course, these are merely example dimensions having advantageous use with 24" on-center truss spacing. It is contemplated herein to provide shelf assemblies 10 in other dimensions that are optimized for other installations. It is also contemplated to provide different shelf assemblies 10 having different load ratings, such as by varying the shelf thicknesses and/or shelving materials, or by providing some models with cross-members/bracing, and others without.

However, in at least one embodiment, the shelf assembly 10 includes a wooden or plastic shelf 12, a metal bracket functioning as the rotatable mounts 30 and two plastic straps functioning as the flexible members 20. The shelf 12 gets positioned at any height between two trusses and the metal bracket on the front is secured with screws on both sides and the straps are secured with screws up higher on the trusses for support. Storage totes or boxes (sold separately) can be placed securely on the shelves. The storage boxes or totes are, in one embodiment, customized for the shelf dimensions. Alternatively, existing, commercially available boxes or totes may be used.

In general, the shelf assembly 10 provides a number of advantages. First, its use of rigid, rotatable mounts at one shelf end and flexible members at the other shelf end, allow the shelf 12 to be easily leveled even when supported by angled framing members, such as attic trusses. With flexible members 20 of sufficient length, the shelf assemblies 10 can be mounted as high or low within the attic space as needed or desired: they can be floated just off the attic floor, or mounted higher to clear other objects, or mounted one above the other, for even more storage space.

Second, the use of rotatable mounts 30 for rotatably mounting one end of the shelf 12 and flexible members 20 for suspending the other end of the shelf 12 allows the same shelf assembly 10 to be mounted to/between exposed wall studs or other vertical framing members, rather than to sloped attic trusses. Moreover, in its wall-mounted configuration, the shelf 12 can be easily rotated out of the way anytime needed.

With the above examples in mind, then, those of ordinary skill in the art will appreciate that the present invention in one or more embodiments comprises a shelf assembly 10 comprising: a shelf 12 defining a load area 18 bounded by shelf edges 14, 16, 22, and 24, including a first edge 16 and an opposite second edge 14; rotatable mounts 30 positioned on opposing sides 22, 24 of the shelf 12 at the first shelf edge 16 and configured for rotatably mounting the shelf 12 at the first shelf edge; and flexible members 20 having free lengths 26 extending from the opposing sides 22, 24 of the shelf 12 at the second shelf edge 14.

Advantageously, the flexible members 20 are configured for suspending the shelf 12 at the second edge 14, based on attaching them to a preexisting structure above a desired mounting location of the shelf 12. This arrangement, including the rotating support provided at the first shelf edge 16, allows the shelf 12 to be leveled by raising or lowering the shelf 12 at its second edge 14—where the suspension height that achieves level mounting of the shelf 12 is easily obtained by adjusting the points along the free lengths 26 of the flexible members 20 at which the flexible members 20 are attached to the overhead supporting structure.

In one embodiment, the flexible members 20 comprise two separate flexible members, each one pre-attached to the shelf 12 at one end and having an opposite free end terminating the free length 26 of the flexible member 20.

In another embodiment, the flexible members 20 comprise opposing sections of a continuous flexible member having a middle portion pre-attached to an underside of the shelf 12, such that said opposing sections provide the free lengths 26 at opposing sides 22, 24 of the shelf at the second edge 14.

In at least one embodiment, at least one of the flexible members 20 incorporates a length adjustment mechanism 60 configured to adjust the free length 26 of the flexible member 20. Such adjustment allows adjustment of the suspended height of the second edge 14 of the shelf 12.

Further, in one or more embodiments, the flexible members each have a terminal end having a terminating tab 62 that includes a pre-formed hanging aperture 64 for detachably hanging from a nail or other protuberance fixed in the preexisting structure above the shelf 12—i.e., above the chosen mounting location of the shelf 12.

Optionally, at least one of the flexible members 20 incorporates a length adjustment mechanism 60 along its free length 26 between the shelf 12 and the terminal end of the flexible member 20, for adjusting the free length 26 and thereby adjusting the suspended height of the second edge 14 of the shelf 12. And, as noted, the flexible members 20 may comprise, for example, straps, ropes, or chains.

In at least one embodiment, the flexible members 20 each include a like positioned and like spaced series of mounting holes 50 along the free length 26, to facilitate attachment of the flexible members 20 at specific points along their free lengths 26. Further, in at least one embodiment with mounting holes 50 in the flexible members 20, the flexible members 20 have indicia 52 (e.g., printed numbers) corresponding to the mounting holes 50, so that a shelf installer can easily identify the same mounting hole 50 in each flexible member 20.

Additionally, in one or more embodiments of the shelf assembly 10 contemplated herein, the shelf assembly 10 includes a rigid member 40 that extends through or under the shelf 12 along the first edge 16, wherein opposing ends of the rigid member 40 provide the rotatable mounts 30, including mounting points 32. This arrangement allows the first edge 16 of the shelf 12 to be supported by horizontally mounting the rigid member 40 to structural supports positioned on the opposing sides 22, 24 of the shelf 12, via the mounting points 32.

In one or more embodiments, an end-to-end length of the rigid member 40 is configured to position the mounting points 32 at a nominal on-center spacing used for attic rafters or wall studs. Further, in one embodiment, the shelf 12 includes an underside channel running along the first edge 16, wherein said rigid member 40 is rotatably captured within the channel.

Further, in the same or another embodiment, the shelf assembly 10 is dimensioned to have standard on-center framing distance between the rotatable mounts 30. Here, the shelf 12 has a width (from edge 22 to edge 24) that is narrower than the standard on-center framing distance, thereby allowing the shelf 12 to be mounted between adjacent framing members that are spaced according to said standard on-center framing distance.

As noted, in one or more embodiments, the rotatable mounts 30 are formed or attached to opposing ends of a rigid member 40 that spans the shelf 12, where the rigid member 40 runs along the first edge 16 and extends from the opposing sides 22, 24 of the shelf 12 at the first edge 16. In such embodiments, the rigid member 40 is rotatably attached to or integrated in the shelf 12, such that the shelf 12 rotates relative to the rigid member 40 and is thereby leveled by mounting the rigid member 40 to an available supporting structure in a horizontal orientation and then adjusting the suspension height of the opposing second edge 14 of the shelf 12 via the flexible members 20.

Of course, the present invention is not limited to the foregoing examples, nor is it limited by the accompanying figures, which are used to illustrate example embodiments and features. Instead, the present invention is limited only by the claims presented for it, and their legal equivalents.

What is claimed is:

1. A shelf assembly for a hanging shelf suspended from adjacent attic rafters or wall studs comprising:

a shelf defining a load area bounded by shelf edges, including a first edge and an opposite second edge;

at least one rod that extends under said shelf along said first edge and provides rod ends projecting outward on opposing sides of the shelf at said first shelf edge, each said rod end comprising a generally ring-shaped end that is configured to receive a fastener and is thereby operative as a mounting point for rotatably mounting said shelf at said first shelf edge, such that said first edge of the shelf is supported by horizontally mounting the rod ends to said adjacent ones of said attic rafters or wall studs on said opposing sides of said shelf via said mounting points and fasteners, and wherein an end-to-end length between the generally ring shaped rod ends is configured to position the mounting points at a nominal on-center spacing of said adjacent ones of said attic rafters or wall studs and an underside of said shelf includes a channel running along said first edge in which said at least one rod is received within to rotatably mount the at least one rod to the underside of said shelf; and flexible members having free lengths extending from said opposing sides of the shelf at said second shelf edge, and configured for suspending the shelf at said second edge based on attaching said flexible members to a preexisting structure above a desired mounting location of said shelf;

wherein said nominal on-center spacing is one of sixteen inches, eighteen inches, and twenty-four inches, and wherein the shelf has a width between said opposing sides of the shelf that is less than said spacing between the mounting points provided by the generally ring-shaped rod ends and is dimensioned to fit between adjacent ones of said attic rafters or wall studs at said nominal on-center spacing.

2. The shelf assembly of claim 1, wherein said flexible members include a length adjustment mechanism configured to adjust a suspended height of said second edge of said shelf.

3. The shelf assembly of claim 1, wherein said flexible members each have a terminal end having a terminating tab that includes a pre-formed hanging aperture for detachably hanging from a nail or other protuberance fixed in said pre-existing structure above said shelf.

4. The shelf assembly of claim 1, wherein said flexible members each comprise a plastic or fabric web and wherein each web includes a correspondingly positioned and correspondingly spaced series of mounting holes along the free length of the web, to facilitate attachment of each flexible member to an available support structure using a selected one of the mounting holes, and further wherein the free lengths of the webs each carries indicia corresponding to the series of mounting holes, to facilitate identification of the correspondingly matching mounting holes in said flexible members.

5. The shelf assembly of claim 1, wherein the at least one rod comprises a single rod, and wherein the generally ring-shaped rod ends projecting outward on opposing sides of the shelf at said first shelf edge are opposing ends of said single rod.

* * * * *